US009643747B2

(12) United States Patent
Fan

(10) Patent No.: US 9,643,747 B2
(45) Date of Patent: May 9, 2017

(54) DISPLAY PACKAGING

(71) Applicant: NIKE, Inc., Beaverton, OR (US)

(72) Inventor: Richard S. Fan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/660,316

(22) Filed: Mar. 17, 2015

(65) Prior Publication Data

US 2016/0272357 A1 Sep. 22, 2016

(51) Int. Cl.

| | |
|---|---|
| ***B65D 5/04*** | (2006.01) |
| ***A63H 33/16*** | (2006.01) |
| ***B65D 85/00*** | (2006.01) |
| ***B65D 5/02*** | (2006.01) |
| ***B65D 5/42*** | (2006.01) |
| ***B65D 5/10*** | (2006.01) |

(52) U.S. Cl.

CPC ..... *B65D 5/029* (2013.01); *B65D 5/04* (2013.01); *B65D 5/106* (2013.01); *B65D 5/4266* (2013.01); *B65D 85/54* (2013.01)

(58) Field of Classification Search

CPC ..... B65D 5/029; B65D 5/04; B65D 5/4266; B65D 85/54; A63H 33/16

USPC ..... 229/111, 115, 116, 116.1; 206/315.9, 206/315.91, 780, 782

See application file for complete search history.

(56) References Cited

U.S. PATENT DOCUMENTS

| | | | |
|---|---|---|---|
| 3,122,298 | A | 2/1964 | Gaylord, Jr. |
| 3,359,657 | A | 12/1967 | Hedberg |
| D245,229 | S | 8/1977 | Hanson |

(Continued)

FOREIGN PATENT DOCUMENTS

| | | | |
|---|---|---|---|
| DE | 202013004500 | U1 | 6/2013 |
| EP | 2492203 | A1 | 8/2012 |

(Continued)

OTHER PUBLICATIONS

Brownlee, John, What if Nike Sold Oranges and Apple Sold iMilk?, Published Jan. 7, 2015, 5 pages. Last accessed Jun. 2, 2015 http://www.fastcodesign.com/3040466/what-if-nike-sold-oranges-and-apple-sold-imilk?utm_source=facebook.

(Continued)

*Primary Examiner* — Gary Elkins

(74) *Attorney, Agent, or Firm* — Shook, Hardy & Bacon L.L.P.

(57) ABSTRACT

A display packaging for receiving and containing a spherical object includes a series of interconnected triangular panels with alternating orientations looped in a circular fashion. Base edges of the triangular panels form pentagonal edges to define two opposing pentagonal voids that expose a substantial portion of two sides of a contained spherical object to allow a consumer to visually inspect and/or feel the spherical object. The display packaging may be assembled from a blank that includes a first region, middle region, and second region. The middle region includes the series of interconnected triangular panels. The first region and second region each includes a series of interconnected and alternating base triangular portions and vertex triangular panels. The display packaging may be assembled from the blank by folding and overlaying first and second regions on the middle region to form a folded blank and looping the folded blank.

19 Claims, 5 Drawing Sheets

(56) References Cited

U.S. PATENT DOCUMENTS

| | | | | | |
|---|---|---|---|---|---|
| 4,063,679 | A | * | 12/1977 | Henry | B65D 5/3614 229/108 |
| 4,142,321 | A | * | 3/1979 | Coppa | A63H 33/16 273/155 |
| 4,177,917 | A | | 12/1979 | Webinger | |
| 5,011,070 | A | | 4/1991 | Plunkett | |
| 5,234,727 | A | * | 8/1993 | Hoberman | A63H 33/16 428/12 |
| 5,253,799 | A | * | 10/1993 | Sebesta | B65D 5/4279 229/108 |
| 5,597,112 | A | | 1/1997 | Knapp | |
| 5,695,056 | A | | 12/1997 | Bender et al. | |
| 5,881,885 | A | | 3/1999 | Grimm | |
| 6,036,010 | A | | 3/2000 | Seyffert et al. | |
| D477,219 | S | | 7/2003 | Waterhouse et al. | |
| D482,273 | S | | 11/2003 | Humphrey | |
| D525,878 | S | | 8/2006 | Wijerama | |
| D529,399 | S | | 10/2006 | Wijerama | |
| D532,686 | S | | 11/2006 | Wijerama | |
| 7,806,313 | B2 | | 10/2010 | Philips | |
| 7,938,259 | B2 | | 5/2011 | Conklin et al. | |
| 8,162,205 | B2 | | 4/2012 | Stephens | |
| D661,161 | S | | 6/2012 | Craft et al. | |
| D663,198 | S | | 7/2012 | White et al. | |
| D672,202 | S | | 12/2012 | Craft et al. | |
| 8,770,401 | B2 | | 7/2014 | Fitchett | |
| 8,777,825 | B1 | * | 7/2014 | Kling | B31B 1/00 493/162 |
| 8,979,608 | B2 | * | 3/2015 | Hawthorne | A63H 33/04 446/109 |

FOREIGN PATENT DOCUMENTS

| | | | | |
|---|---|---|---|---|
| FR | 842318 | A * | 2/1939 | B65D 5/029 |
| FR | 2881983 | A1 * | 8/2006 | B65D 5/029 |
| JP | S60171815 | A | 9/1985 | |
| JP | H11124124 | A | 5/1999 | |

OTHER PUBLICATIONS

International Search Report and Written Opinion dated May 27, 2016 for PCT Patent Application No. PCT/US2016/022636, 11 pages.

* cited by examiner

DISPLAY PACKAGING

BACKGROUND

Many athletic activities, particularly team sports, utilize one of a variety of game ball types. For example, the game of soccer utilizes a soccer ball, whereas the game of basketball utilizes a basketball. Other types of game balls that are commonly utilized include footballs, volleyballs, baseballs, and softballs, for example. The suitability of a type of game ball for a particular athletic activity depends upon a variety of characteristics, including dimensions, shape, materials, and weight.

When purchasing game balls, consumers generally prefer to inspect the game balls, which may include both a visual inspection and a tactile inspection (i.e., through touch) to ensure that the game balls possess the requisite characteristics. Moreover, inspection of the game balls permits the consumers to verify whether the game balls possess a requisite degree of quality, which is dependent upon workmanship and materials. Packaging, such as a conventional box, may inhibit consumers' ability to inspect game balls. Accordingly, many manufacturers transport game balls to retail locations without packaging, and the game balls are displayed in bulk at the retail locations in a large bin or basket.

One drawback to displaying game balls without packaging is that information regarding the game balls may not be provided to the consumers. For example, when game balls are loosely displayed in a large bin or basket, information on materials used in the game balls, specifications of the game ball, and approval from governing athletic organizations may not be coupled with the game balls for use by the consumers when selecting between models or manufacturers. Another drawback relates to protection of the game balls. That is, damage to the game balls may occur during transport or while on display at the retail location.

SUMMARY

Embodiments of the present invention relate to a display packaging for receiving and containing a spherical object. The display packaging includes opposing pentagonal voids exposing a substantial portion of two sides of the spherical object allowing a consumer to visually inspect and/or feel the spherical object. The display packaging also generally provides protection to the spherical object contained therein (e.g., during transport and while displayed at a retail location), opposing flat and parallel surfaces for stacking of multiple display packages, and an area for providing information regarding the spherical object.

The display packaging comprises a series of interconnected triangular panels looped in a circular fashion. The interconnected triangular panels include alternating orientations such that a base edge of each triangular panel adjoins a vertex of adjacent triangular panels. The base edges for a first set of the interconnected triangular panels cooperate to form a first pentagonal edge defining a first pentagonal void. The base edges for a second set of the interconnected triangular panels cooperate to form a second pentagonal edge defining a second pentagonal void. Each triangular panel has an opposing triangular panel to provide opposing flat surfaces for stacking purposes (e.g., during transport and while displayed at a retail location).

The display packaging may be formed from a blank that includes a middle region adjoining a first region at a first fold line and a second region at a second fold line. The middle region includes a series of interconnected triangular panels. Each triangular panel from a first set of the interconnected triangular panels has a first orientation with a base edge adjoining the first region and a vertex adjoining the second region. Each triangular panel from a second set of the interconnected triangular panels has a second orientation with a base edge adjoining the second region and a vertex adjoining the first region. Each of the first region and the second region includes a series of alternating base truncated triangular portions and vertex triangular portions. The display packaging may be assembled from the blank by folding and overlaying the first region and the second region on the middle region to form a folded blank. The folded blank is then looped in a circular fashion and a first end of the folded blank is affixed to a second end of the folded blank to form the display packaging.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Figure 1:
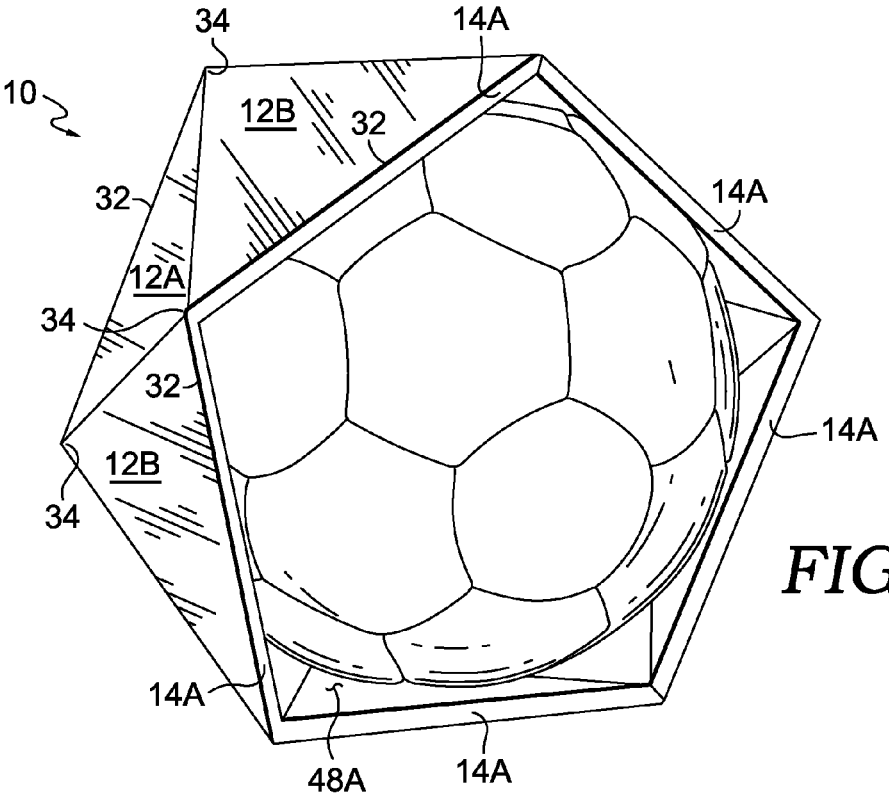
FIG. 1 is a perspective view of an assembled display packaging containing a soccer ball.
Figure 2:
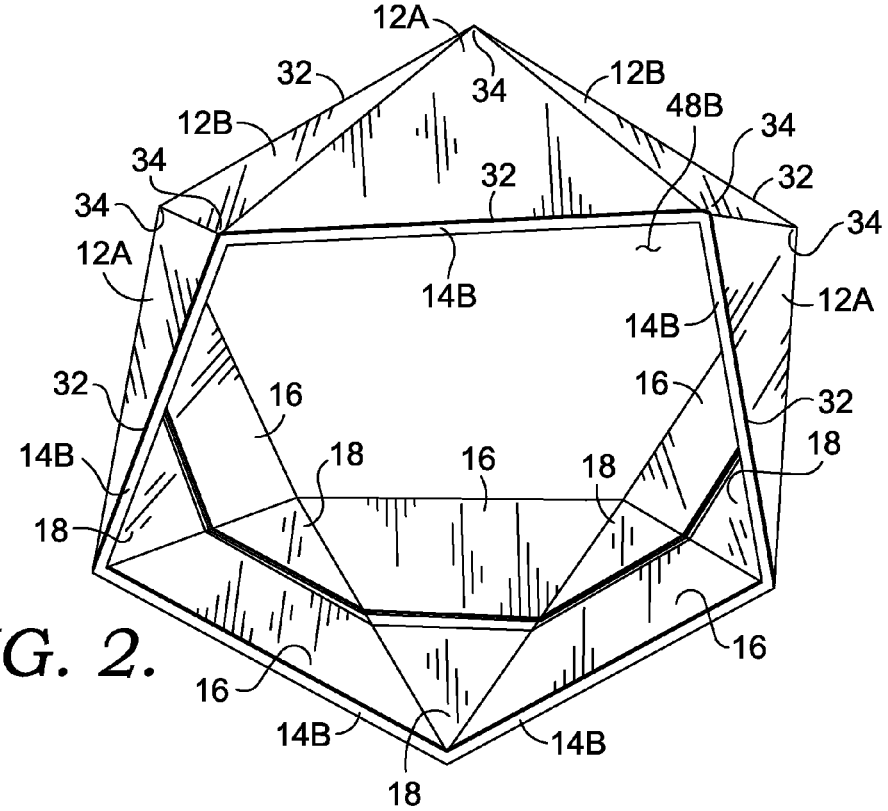
FIG. 2 is a perspective view of an assembled display packaging without containing an object.

With reference to the drawings, wherein like reference characters designate like parts throughout the different views, a display packaging according to an embodiment of the present invention is designated generally with the reference numeral 10. In an assembled state, as shown in FIGS. 1 and 2, the display packaging 10 may be used to receive and contain spherical objects, such as a soccer ball as shown in FIG. 1. Although FIG. 1 illustrates the display packaging 10 containing a soccer ball, the display packaging 10 may be particularly suited to contain any inflatable game ball, such as a basketball or volleyball, as well as a non-inflatable game ball, such as a baseball, softball, golf ball, or tennis ball. However, it should be understood that the display packaging 10 is not limited to game balls and may be used to receive and contain any spherical object.

The display packaging 10 generally includes a series of ten interconnected and opposing triangular panels 12A and 12B that are looped in a circular fashion to form two opposing pentagonal voids, including a first pentagonal void 48A and a second pentagonal void 48B. The display packaging 10 provides protection to the spherical object contained therein, including during transport and while displayed at a retail location. The display packaging 10 also provides an area for providing information regarding the spherical object. The pentagonal voids 48A and 48B allow a substantial portion of two sides of a contained spherical object to be exposed to allow a consumer to visually inspect and feel the spherical object.

Five of the triangular panels 12A are oriented in one direction with a base edge 32 adjacent the second pentagonal void 48B and a vertex 34 adjacent the first pentagonal void 48A, while the other five triangular panels 12B are oriented in an opposite direction with a base edge 32 adjacent the first pentagonal void 48A and a vertex 34 adjacent the second pentagonal void 48B. Additionally, a series of five first pentagonal edges 14A are formed at the base edges 32 of the triangular panels 12B and have a face that is perpendicular to a face of the triangular panels 12B. Likewise, a series of second pentagonal edges 14B are formed at base edges 32 of the triangular panels 12A and have a face that is perpendicular to a face of the triangular panels 12A.

The display packaging 10 may be sized based on the size of the spherical object to be contained by the display packaging 10. More particularly, the display packaging 10 may be sized such that an interior surface of the display packaging 10 engages with portions of the spherical object when the spherical object is received within the display packaging 10 to thereby inhibit or prevent movement of the spherical object relative to the display packaging 10. In some embodiments, an interior face of the triangular panels 12A and 12B may provide the interior surface that engages the spherical object. In other embodiments, the interior surface may be provided by two series of interconnected base truncated triangular portions 16 and vertex triangular portions 18 that will be described in further detail below.

As shown in FIGS. 1 and 2, each triangular panel 12A has an opposing triangular panel 12B such that when the display packaging 10 is placed on a surface, such as a store shelving, the display packaging 10 rests on either a triangular panel 12A or 12B, and an opposing triangular panel 12B or 12A, respectively, is provided on the top of the display packaging 10. This facilitates stacking a number of display packagings together (e.g., on a store shelving, in boxes for transportation, etc.). In this example, the top triangular panel and the opposing and oppositely oriented bottom triangular panel may form parallel planes to one another, which is useful for multi-level stacked display packaging.

Figure 3:
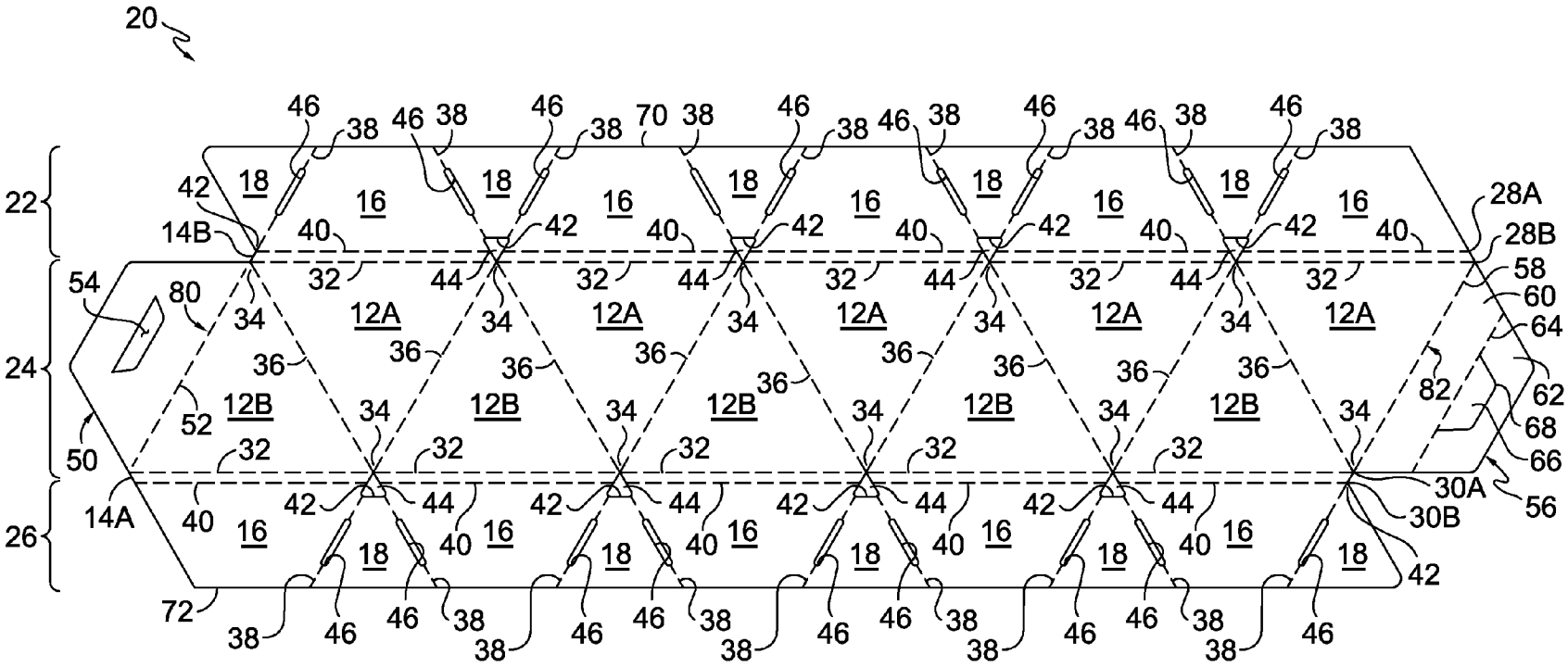
FIG. 3 is a plan view of a blank used to form a display packaging including a first region, middle region, and second region.

The display packaging 10 may be formed from a blank 20, as shown in FIG. 3, which provides a plan view of the blank 20. The blank 20 may be made of any material known in the art. By way of example only and not limitation, the blank 20 may be made of a paper product (e.g., paperboard or cardboard), polymers, or other suitable material. Additionally, the material may be a recycled or other post-consumer material. The blank 20 is preferably formed from a single element of material that is stamped to generate the blank 20, which may then be folded to form the display packaging 10 as will be described in further detail below. However, in some embodiments, two or more elements may be joined to form the blank 20.

As shown in FIG. 3, the blank 20 includes a first region 22, a middle region 24, and a second region 26. The middle region 24 is separated from the first region 22 by a pair of fold lines 28A and 28B and from the second region 26 by a pair of fold lines 30A and 30B. The portion of the blank 20 between the fold lines 28A and 28B provides the second pentagonal edge 14B, and the portion between the fold lines 30A and 30B provides the first pentagonal edge 14A. Although FIG. 3 illustrates a pair of fold lines 28A and 28B separating the middle region 24 and the first region 22, in some embodiments, only a single fold line may be employed. Likewise, although FIG. 3 illustrates a pair of fold lines 30A and 30B separating the middle region 24 and the second region 26, in some embodiments, only a single fold line may be employed. In an exemplary aspect, the double fold lines provide for a finished appearing edge (e.g., pentagonal edge 14B) and compensates for a thickness of the material from which the blank 20 is constructed. The compensation or the thickness may facilitate a folding operation that is maintained and less resisted by a compressive force on the material forming the blank 20.

The middle region 24 includes ten interconnected triangular panels 12A and 12B that are separated by fold lines 36. A first series of five triangular panels 12A are each oriented with a base edge 32 that adjoins the first region 22 and a vertex 34 that adjoins the second region 26. A second series of five triangular panels 12B have an opposite orientation, each having a base edge 32 that adjoins the second region 26 and a vertex 34 that adjoins the first region 22.

Each of the first region 22 and second region 26 comprises a series of interconnected base truncated triangular portions 16 and vertex triangular portions 18 that are separated by fold lines 38. Each of the base truncated triangular portions 16 is the base portion of a triangle shape that approximates the shape of the triangular panels 12A and 12B. For example, a base truncated triangular portion may be a trapezoid, such as an isosceles trapezoid. Each of the vertex triangular portions 18 is the vertex portion of a triangle shape that approximates the shape of the triangular panels 12A and 12B. Each base truncated triangular portion 16 from the first region 22 includes a base edge 40 that adjoins the base edge 32 of a triangular panel 12A at the fold lines 28A and 28B, while each vertex triangular portion 16 from the first region 22 includes a vertex 42 that adjoins the vertex 34 of a triangular panel 12B at the fold lines 28A and 28B. Likewise, each base truncated triangular portion 16 from the second region 26 includes a base edge 40 that adjoins the base edge 32 of a triangular panel 12B at the fold lines 30A and 30B, while each vertex triangular portion 18 from the second region 26 includes a vertex 42 that adjoins the vertex 34 of a triangular panel 12A at the fold lines 30A and 30B.

In some embodiments, some openings may be provided at the fold lines 38 in the first region 22 and second region 26 to prevent unintended deformation (e.g., crumpling) when the display packaging 10 is assembled. For instance, as shown in FIG. 3, openings 44 may be provided where the vertex 42 of each vertex triangular portion 18 adjoins a vertex 34 of the triangular panels 12A and 12B. Additionally or alternatively, slit openings 46 may be provided in the fold lines 38 (e.g., in the center of the folds lines 38). The length and thickness of the openings 44 and slit openings 46 may be configurable based, for instance, on the thickness of the material used to generate the blank 29 in order to prevent crumpling of the material. For example, thicker material may warrant using larger openings.

Figure 4:
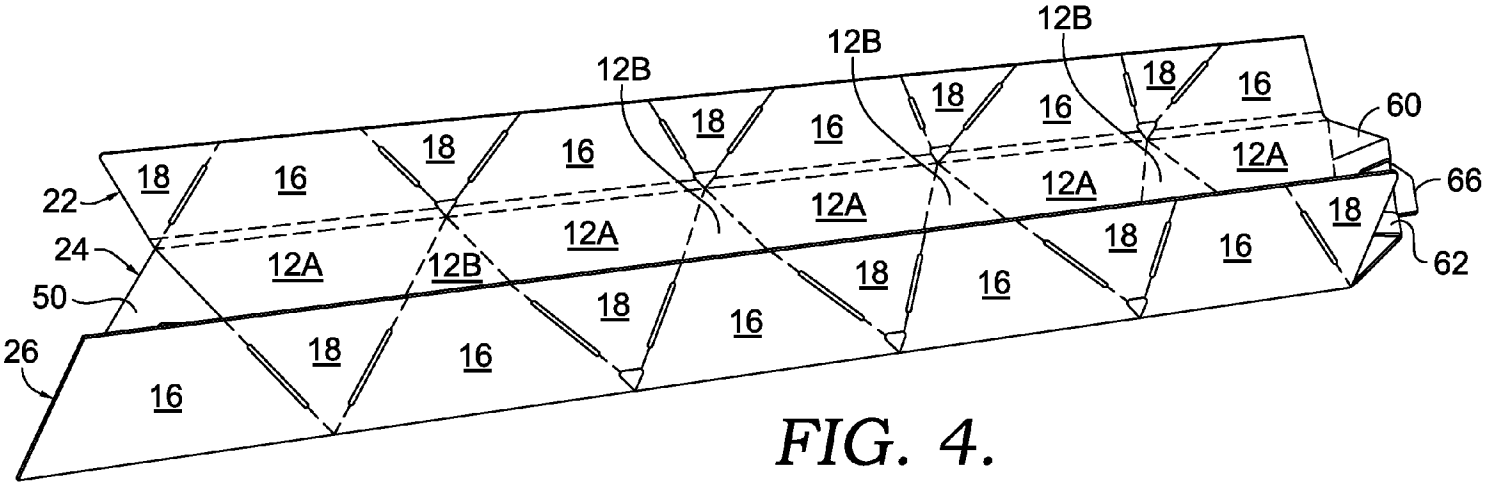
FIG. 4 is a perspective view of the blank of FIG. 3 showing the first region and the second region of the blank being folded at fold lines adjoining the middle region.
Figure 5:
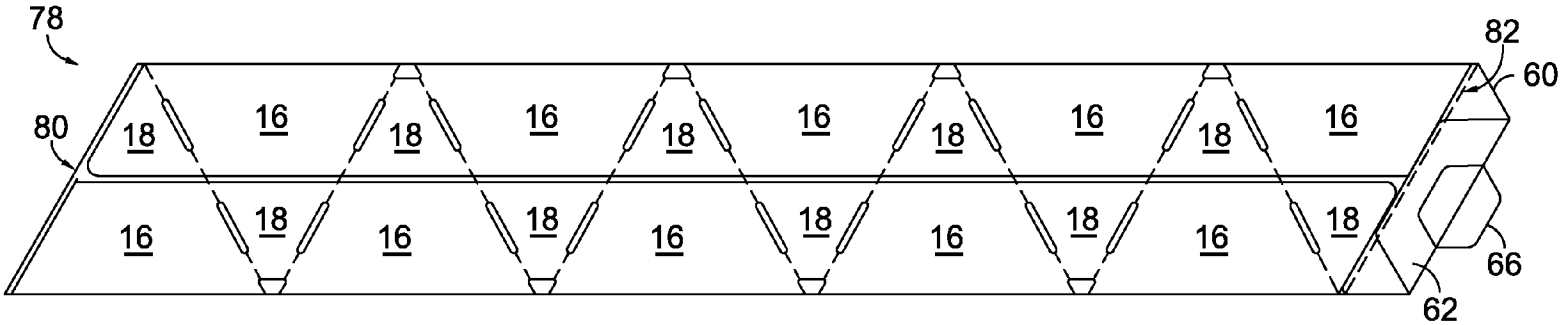
FIG. 5 is a plan view of a folded blank resulting from folding and overlaying the first region and the second region of the blank on the middle region of the blank.

The series of interconnected triangular panels 12A and 12B of the middle region 24 include a first connection flap 50 at a first end 80 of the middle region 24 and a second connection flap 56 at a second end 82 of the middle region 24 that facilitate connecting the triangular panels 12A and 12B to form the display packaging 10 as will be described in further detail below. The first connection flap 50 adjoins a triangular panel 12B at a fold line 52 and includes an opening 54. The second connection flap 56 adjoins a triangular panel 12A at a fold line 58 and includes a main portion 60 and flap portion 62 separated by a fold line 64. Additionally, a tab 66 is formed in the flap portion 62 by a cut line 68. It is contemplated that a first connection flap (e.g., first connection flap 50) adjoins a triangular panel 12A and a second connection flap (e.g., second connection flap 56) adjoins a triangular panel 12B, in an alternative aspect. It is also contemplated that other approaches may be used to connect the first end 80 and the second end 82 of the triangular panels 12A and 12B To assemble the display packaging 10, as illustrated in FIGS. 4 and 5, the first connection flap 50 is folded at the fold line 52 and overlayed on the adjacent triangular panel 12B. In some instances, the connection flap 50 may be affixed to the adjacent triangular panel 12B using, for instance, glue or staples. Additionally, the first region 22 is adapted to fold at the fold lines 28A and 28B and overlay the middle region 24. Likewise, the second region 26 is adapted to fold at the fold lines 30A and 30B and overlay the middle region 24. The base truncated triangular portions 16 and vertex triangular portions 18 of the first region 22 and second region 26 are sized such that they do not overlap each other when folded and overlayed on the middle region 24. In some embodiments, the size of the first region 22 as measured from an outside edge 70 to the fold line 28A is the same as the size of the second region 26 as measured from an outside edge 72 to the fold line 30B. In other embodiments, such sizing of the first region 22 and the second region 26 may differ.

When the first region 22 and the second region 26 are overlayed on the middle region 24, the fold lines 38 in the first region 22 and second region 26 overlay respective fold lines 36 of the middle region 26. Additionally, the first region 22 and second region 26 may be affixed to the middle region 24 using, for instance, glue or staples. As shown in FIG. 5, a folded blank 78 is formed by overlaying the first region 22 and the second region 26 on the middle region 24. For example, it is contemplated that an adhesive may be applied or placed proximate an outside edge of the first region 22 and the second region 26 such that when folded to the middle region 24, the adhesive bonds the respective regions together in the folded configuration. Similarly, it is contemplated that an adhesive may be applied or placed within an overlapping region of the middle region 24 that will be overlapped by one of the first region 22 or the second region 26 to secure a respective region with the middle region 24. Other variations, such as a combination of adhesive on the first region 22, the middle region 24, and/or the second region 26, are contemplated herein for securing the first region 22 with the middle region 24 and the second region 26 with the middle region 24.

Figure 6:
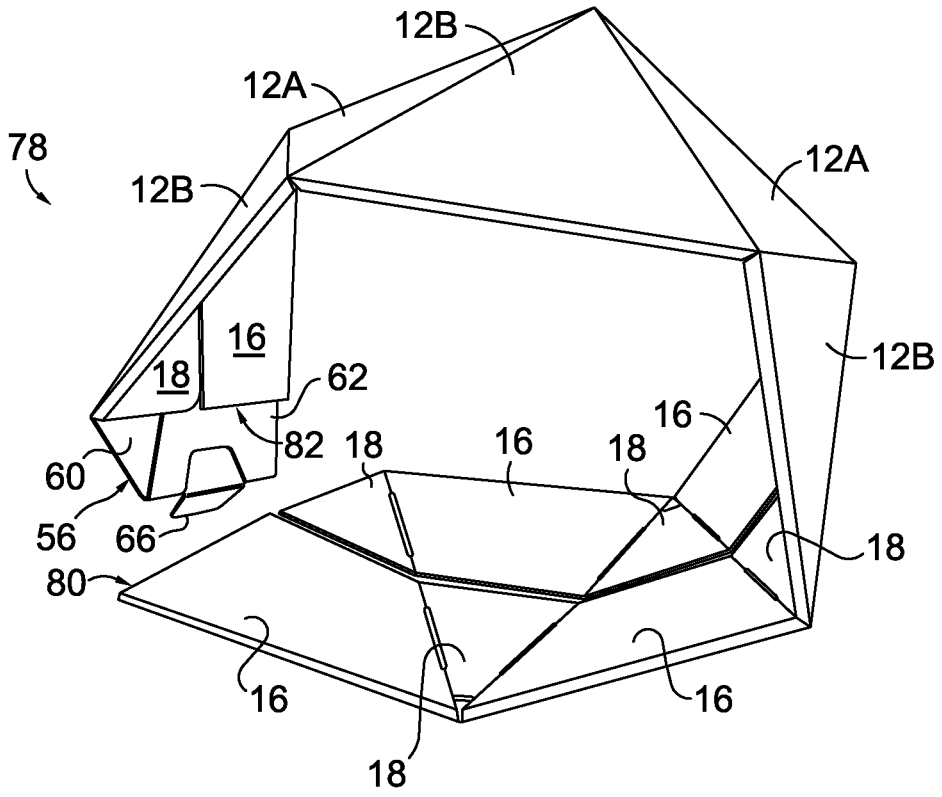
FIG. 6 is a perspective view of the folded blank of FIG. 5 being looped in a circular fashion in order to form a display packaging.

To form the assembled display packaging 10, after overlaying the first region 22 and second region 26 on the middle region 24, the folded blank 78 is looped in a circular fashion, as shown in FIG. 6, and the first end 80 and second end 82 of the folded blank 78 are joined using the first connection flap 50 and the second connection flap 56. The flap portion 62 of the second connection flap 56 is folded at fold line 64 and overlayed on a first face of the main portion 60 of the second connection flap 56. The flap portion 62 may be affixed to the main portion 60 using, for instance, glue or staples. The tab 66 is folded such that it overlays the opposing second face of the main portion 60 of the second connection flap 56.

Figure 7:
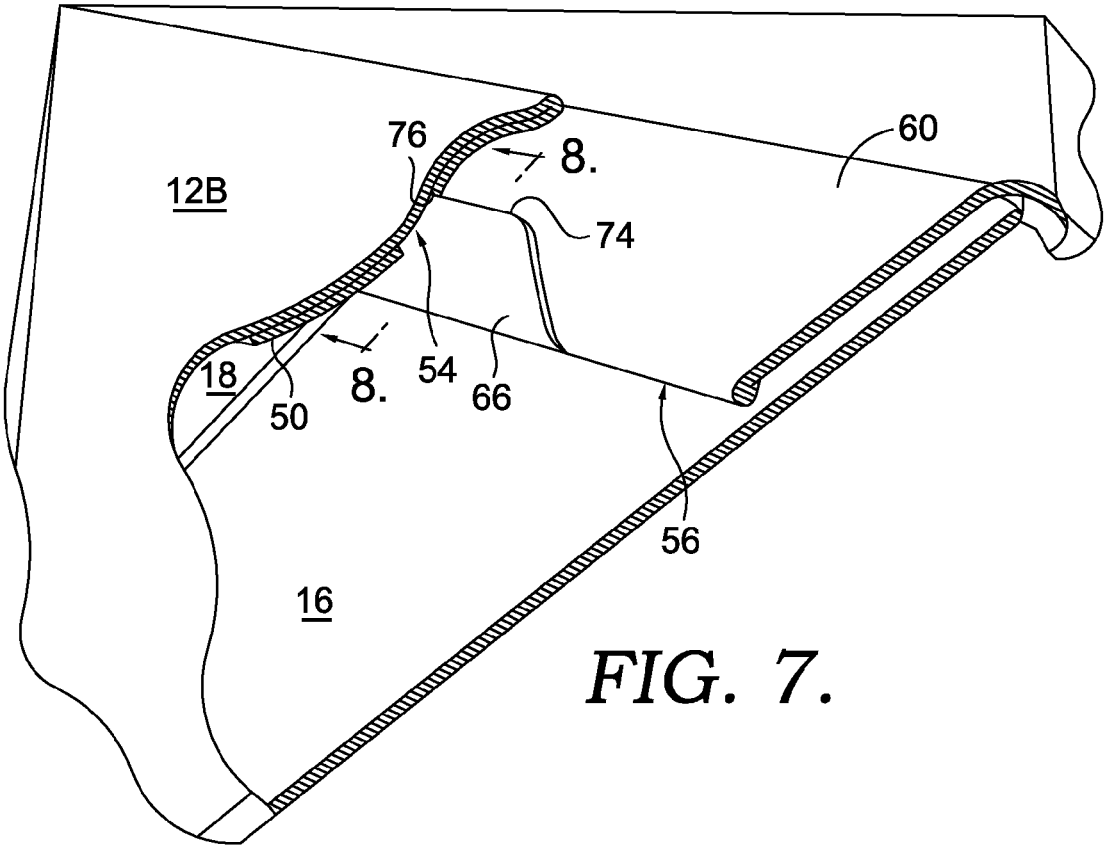
FIG. 7 is a cutaway view illustrating a first connection flap engaging a second connection flap to affix a first end of the folded blank to a second end of the folded blank to form a display packaging.
Figure 8:
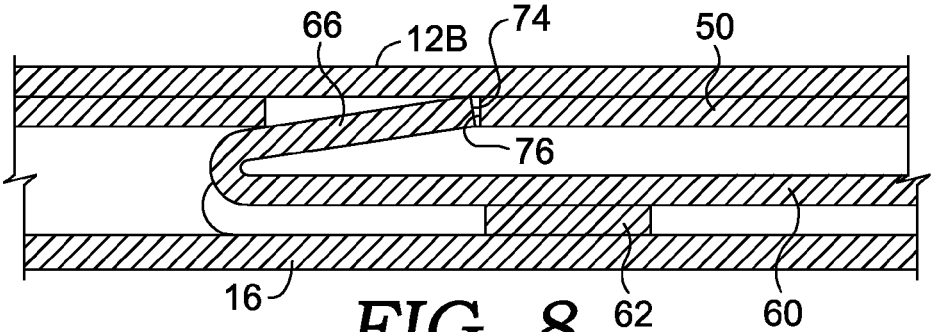
FIG. 8 is a cross-sectional view taken along the line 8-8 of FIG. 7 illustrating the first connection flap engaging the second connection flap.

As shown in FIGS. 7 and 8, the second connection flap 56 is slid between a triangular panel 12B and overlayed base truncated triangular portion 16 and vertex triangular portion 18 (note that the base truncated triangular portion 16 and vertex triangular portion 18 at this location may not be affixed to the triangular panel 12B to allow for the second connection flap 56 to be inserted). An outside edge 74 of the tab 66 on the second connection flap 56 engages an edge 76 of the opening 54 of the first connection flap 50, thereby joining the first end 80 and second end 82 of the folded blank 78 and completing assembly of the display packaging 10.

Accordingly, among many embodiments of the present invention, one aspect is directed to a structure configurable to form a display packaging. The structure includes a middle region adjoining a first region at a first fold line and adjoining a second region at a second fold line. The middle region includes a series of interconnected triangular panels. Each triangular panel from a first set of the interconnected triangular panels has a first orientation with a base edge adjoining the first region and a vertex adjoining the second region. Each triangular panel from a second set of the interconnected triangular panels has a second orientation with a base edge adjoining the second region and a vertex adjoining the first region. The first region includes a first series of alternating base truncated triangular portions and vertex triangular portions. The second region includes a second series of alternating base truncated triangular portions and vertex triangular portions.

In another aspect, an embodiment of the present invention provides a display packaging for receiving and containing a spherical object. The display packaging includes a series of ten interconnected triangular panels formed in a loop defining a first pentagonal void and an opposing second pentagonal void. Each triangular panel from a first set of the interconnected triangular panels has a first orientation with a base edge adjoining the first pentagonal void and a vertex adjoining the second pentagonal void. Each triangular panel from a second set of the interconnected triangular panels has a second orientation with a base edge adjoining the second pentagonal void and a vertex adjoining the first pentagonal void. The display packaging also includes a first series of five pentagonal edges adjoining the base edges of the first set of the interconnected triangular panels at a first fold line. Each pentagonal edge from the first series of pentagonal edges has a face that is perpendicular to an outside face of an adjoining triangular panel from the first set of interconnected triangular panels. The display packaging further includes a second series of five pentagonal edges adjoining the base edges of the second set of the interconnected triangular panels at a second fold line, each pentagonal edge from the second series of pentagonal edges having a face that is perpendicular to an outside face of an adjoining triangular panel from the second set of interconnected triangular panels. The display packing further includes a first inner region comprising a first series of interconnected and alternating base truncated triangular portions and vertex triangular portions overlayed on an inside face of the series of interconnected triangular panels. Each base truncated triangular portion from the first inner region has a base edge that adjoins a pentagonal edge from the first series of pentagonal edges at a third fold line. Each vertex triangular portion from the first inner region has a vertex that adjoins a pentagonal edge from the first series of pentagonal edges at the third fold line. The display packaging further includes a second inner region comprising a second series of interconnected and alternating base truncated triangular portions and vertex triangular portions overlayed on the inside face of the series of interconnected triangular panels. Each base truncated triangular portion from the second inner region has a base edge that adjoins a pentagonal edge from the second series of pentagonal edges at a fourth fold line. Each vertex triangular portion from the second inner region has a vertex that adjoins a pentagonal edge from the second series of pentagonal edges at the fourth fold line.

A further embodiment is directed to a display packaging for receiving and containing a spherical object. The display packaging includes a series of ten interconnected triangular panels with alternating orientations such that a base edge of each triangular panel adjoins a vertex of adjacent triangular panels. The series of interconnected triangular panels is looped with the base edges of a first set of the interconnected triangular panels cooperating to form a first pentagonal edge defining a first pentagonal void and the base edges of a second set of the interconnected triangular panels cooperating to form a second pentagonal edge defining a second pentagonal void.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and/or steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A structure configurable to form a display packaging, the structure comprising:

a middle region adjoining a first region at a first fold line and adjoining a second region at a second fold line, the middle region including a series of interconnected triangular panels, each triangular panel from a first set of the interconnected triangular panels having a first orientation with a base edge adjoining the first region and a vertex adjoining the second region, each triangular panel from a second set of the interconnected triangular panels having a second orientation with a base edge adjoining the second region and a vertex adjoining the first region;

the first region including a first series of alternating base truncated triangular portions and vertex triangular portions; and the second region including a second series of alternating base truncated triangular portions and vertex triangular portions.

2. The structure of claim 1, wherein the middle region adjoins the first region at a pair of fold lines that includes the first fold line, and the middle region adjoins the second region at a second pair of fold lines that includes the second fold line.

3. The structure of claim 1, wherein a size of the first region as measured from an outside edge of the first region to the first fold line matches a size of the second region as measured from an outside edge of the second region to the second fold line.

4. The structure of claim 1, wherein the first region and the second region include an opening at a vertex of each of at least a portion of the vertex triangular portions.

5. The structure of claim 1, wherein the first region and the second region include a slit opening along each of a plurality of fold lines separating a base truncated triangular portion and a vertex triangular portion.

6. The structure of claim 1, wherein a first end of the middle region includes a first connection portion adjoining a first triangular panel and an opposing second end of the middle region includes a second connection portion adjoining a second triangular panel, the first connection portion being configured to engage the second connection portion to affix the first and second ends of the middle region when forming the display packaging.

7. The structure of claim 6, wherein the first connection portion comprises a first connection flap having an opening therein and being configured to fold inward and overlay the first triangular panel when forming the display packaging.

8. The structure of claim 7, wherein the second connection portion comprises a second connection flap having a tab configured to engage the opening in the first connection flap when forming the display packaging.

9. The structure of claim 1, wherein the structure is made of a paper material.

10. A display packaging for receiving and containing a spherical object, the display packaging comprising:

a series of ten interconnected triangular panels formed in a loop defining a first pentagonal void and an opposing second pentagonal void, each triangular panel from a first set of the interconnected triangular panels having a first orientation with a base edge adjoining the first pentagonal void and a vertex adjoining the second pentagonal void, each triangular panel from a second set of the interconnected triangular panels having a second orientation with a base edge adjoining the second pentagonal void and a vertex adjoining the first pentagonal void;

a first series of five pentagonal edges adjoining the base edges of the first set of the interconnected triangular panels at a first fold line, each pentagonal edge from the first series of pentagonal edges having a face that is perpendicular to an outside face of an adjoining triangular panel from the first set of interconnected triangular panels;

a second series of five pentagonal edges adjoining the base edges of the second set of the interconnected triangular panels at a second fold line, each pentagonal edge from the second series of pentagonal edges having a face that is perpendicular to an outside face of an adjoining triangular panel from the second set of interconnected triangular panels;

a first inner region comprising a first series of interconnected and alternating base truncated triangular portions and vertex triangular portions overlayed on an inside face of the series of interconnected triangular panels, each base truncated triangular portion from the first inner region having a base edge that adjoins a pentagonal edge from the first series of pentagonal edges at a third fold line, each vertex triangular portion from the first inner region having a vertex that adjoins a pentagonal edge from the first series of pentagonal edges at the third fold line; and a second inner region comprising a second series of interconnected and alternating base truncated triangular portions and vertex triangular portions overlayed on the inside face of the series of interconnected triangular panels, each base truncated triangular portion from the second inner region having a base edge that adjoins a pentagonal edge from the second series of pentagonal edges at a fourth fold line, each vertex triangular portion from the second inner region having a vertex that adjoins a pentagonal edge from the second series of pentagonal edges at the fourth fold line.

11. The display packaging of claim 10, wherein a size of the first inner region as measured from an outside edge of the first inner region to the third fold line matches a size of the second inner region as measured from an outside edge of the second inner region to the fourth fold line.

12. The display packaging of claim 10, wherein the first inner region and the second inner region include an opening at the vertex of each of the vertex triangular portions.

13. The display packaging of claim 10, wherein the first inner region and the second inner region include a slit opening along each of a plurality of fold lines separating a base truncated triangular portion and a vertex triangular portion.

14. The display packaging of claim 10, wherein the series of interconnected triangular panels are maintained in the loop by a first connection portion adjoining a first triangular panel of the interconnected triangular panels affixed to a second connection portion adjoining a second triangular panel of the interconnected triangular panels.

15. The display packaging of claim 14, wherein the first connection portion comprises a first connection flap having an opening therein and folded inward and overlayed on the first triangular panel.

16. The display packaging of claim 15, wherein the second connection portion comprises a second connection flap having a tab with an edge that engages an edge of the opening in the first connection flap.

17. A display packaging for receiving and containing a spherical object, the display packaging comprising:

a series of ten interconnected triangular panels with alternating orientations such that a base edge of each triangular panel adjoins a vertex of adjacent triangular panels, the series of interconnected triangular panels being looped with the base edges of a first set of the interconnected triangular panels cooperating to form a first pentagonal edge defining a first pentagonal void and the base edges of a second set of the interconnected triangular panels cooperating to form a second pentagonal edge defining a second pentagonal void;

a first inner region comprising a first series of interconnected and alternating base truncated triangular portions and vertex triangular portions overlayed on an inside face of the series of interconnected triangular panels, the first inner region adjoining the first pentagonal edge; and a second inner region comprising a second series of interconnected and alternating base truncated triangular portions and vertex triangular portions overlayed on the inside face of the series of interconnected triangular panels, the second inner region adjoining the second pentagonal edge.

18. The display packaging of claim 17, wherein the display packaging is maintained in a loop by a first connection portion adjoining a first triangular panel of the interconnected triangular panels affixed to a second connection portion adjoining a second triangular panel of the interconnected triangular panels.

19. The display packaging of claim 18, wherein the first connection portion comprises a first connection flap having an opening therein and folded inward and overlayed on the first triangular panel, and wherein the second connection portion comprises a second connection flap having a tab with an edge that engages an edge of the opening in the first connection flap.

* * * * *